United States Patent [19]

Kuparinen

[11] 4,086,011

[45] Apr. 25, 1978

[54] SEALING GASKET FOR A CAPILLARY PEN COVER

[75] Inventor: Lasse Kuparinen, Sulfeld, Germany

[73] Assignee: Koh-I-Noor Rapidograph, Inc., Bloomsbury, N.J.

[21] Appl. No.: 770,491

[22] Filed: Feb. 22, 1977

[30] Foreign Application Priority Data

Mar. 22, 1976 Germany ..... 2612072

[51] Int. Cl.[2] ..... B43K 9/00; B43K 1/00

[52] U.S. Cl. ..... 401/258

[58] Field of Search ..... 401/258–260, 401/262, 269, 194, 243–247

[56] References Cited

U.S. PATENT DOCUMENTS

| | | | |
|---|---|---|---|
| 3,475,103 | 10/1969 | Danjczek | 401/243 X |
| 3,802,788 | 4/1974 | Danjczek | 401/258 X |
| 3,963,359 | 6/1976 | Anderica | 401/258 |

*Primary Examiner*—Stephen C. Pellegrino
*Attorney, Agent, or Firm*—David H. Semmes

[57] ABSTRACT

Capillary writing pen of the type embodying a sleeve, an ink reservoir supported within the sleeve and a tubular writing point extending from the reservoir and through the bottom of the sleeve. Particularly, a sealing gasket supported within the cover for the sleeve, so as to seal both an expansion chamber leading to the ink reservoir and the tubular writing end or tip. The sealing gasket is characterized by its axial extensibility in the form of a bellows and, thus, accommodates tubular writing points of varying diameters and lengths.

6 Claims, 2 Drawing Figures

SEALING GASKET FOR A CAPILLARY PEN COVER

BACKGROUND OF THE INVENTION

1. Field of the Invention

The present invention concerns a gasket element for the covering cap of a tubular writing pen of the type having a sleeve body enclosure, an ink reservoir and a capillary channel extending into a tubular writing element. The gasket is in the form of a cup-shaped element consisting of elastic material which has an upper annular sealing surface as a sealing support for the front edge of the sleeve body and writing socket beyond which extends the writing element.

Such gasket elements for pen quivers or pen covering caps, respectively, are generally known. A gasket element inserted into a covering cap is described in West German Utility Pat. No. 1,935,398 consists of an elastic material and has essentially the shape of a cup, so that the upper extremity is cylindrical and defines an upper edge forming an annular sealing surface which is in contact with the front edge of the sleeve body surrounding the writing socket, as the tubular pen is tightly screwed or inserted into the covering cap.

However, in the case of tubular writing pens, not only the area between the sleeve body and writing socket, for example, the outlet area of an ink equalizing chamber, should be sealed off against the surrounding air. Simultaneously, also, the tubular writing element should be sealed off. However, it has been determined that, when utilizing a cup-shaped gasket element effective sealing of the writing element could not be achieved in the long run. In order to achieve a sufficient dual sealing effect, the front end of the tubular writing element must be pushed against the bottom surface of the cup-shaped element with a certain pressure, so that his bottom surface elastically deforms and rests tightly against the front end of the tubular writing element giving a sealing effect. Very frequently, this resulted in penetration into the material of the bottom surface by the tubular writing element and resultant damaging of the bottom surface which actually impaired the sealing effect.

Another problem arises particularly in the case of tubular pens for extremely low widths of lines, e.g. about 0.1 mm, since, in the case of these tubular pens, the tubular writing elements are very thin and can be bent simply by means of the load resulting from the pressing of the tubular writing element upon the bottom surface of the cup-shaped element.

Finally, tubular pens for different widths of lines have specific deviations in their dimensions which can amount up to ± 1 mm in extreme cases. If a gasket element of a certain dimension would be used for all these tubular pens, it is quite obvious that then there would be no sealing effect at all at the tubular writing element in the case of some tubular pens and/or, in the case of other tubular pens, the tubular writing elements would penetrate into the material of the bottom surface of the gasket element or the tubular writng element would be bent or broken off.

SUMMARY OF THE INVENTION

It is, therefore, an object of invention to create a gasket element for the covering cap of a tubular pen which has a sealing effect both in the area of the outlet end of the ink equalizing chamber, as well as at the front end of the tubular writing element and which can particularly be used without alteration for tubular pens having different dimensions for different width of lines.

This problem is solved by the present invention. A gasket element in cup shape is constructed in such a manner that its lateral wall can be elastically extended in an axial direction in order to enlarge the distance between the annular sealing surface and the bottom surface of the cup-shaped element. Thus, the bottom surface can be brought into a sealing contact with the front end or tip of the tubular writing element. Preferably, at least a partial area of the lateral wall of the cup-shaped element is designed as a bellows in order to permit axial extension of this lateral wall.

As a result of this construction of the gasket element within a covering cap, the distance between the annular sealing surface and the bottom surface in the non-extended or rest position, i.e. when the tubular pen is not inserted, can be shorter than the distance between the front edge of the sleeve body surrounding the writing socket and the front end or tip of the tubular writing element to be inserted in the cap. The bottom surface upon insertion of the tubular pen is then elastically shifted in an axial direction by the contact of the tubular writing element end until the front edge of the sleeve body rests against the annular sealing surface. Thus, the sealing contact between bottom surface of the gasket element and the front end or tip of the tubular writing element is maintained without any danger of penetration of the tubular writing element into the bottom surface. Furthermore, due to the relatively slight resistance against extension of the lateral wall of the gasket element, the danger does not exist that tublar writing elements for thin widths of lines would be bent or broken off.

It should be pointed out that the contact pressure of the front end or tip of the tubular writing element upon the bottom surface of the gasket element need only be a very slight one in order to achieve a sufficient sealing effect, so that the resistance of the lateral wall of the cup-shaped element against axial tension can be set at a very low degree.

In order to obtain a proper guidance and sealing in the area of the annular sealing surface, the latter can be inset beneath the upper edge of the cup-shaped element, so that the intervening cylindrical area between the upper edge and the annular sealing surface can serve as a guide when inserting the tubular writing element, as well as a receiving socket for the inserted tubular writing element.

The gasket element can, for example, be made of silicone rubber which is particularly suitable as elastic material for sealing purposes.

DESCRIPTION OF THE PREFERRED EMBODIMENTS

Figure 1:
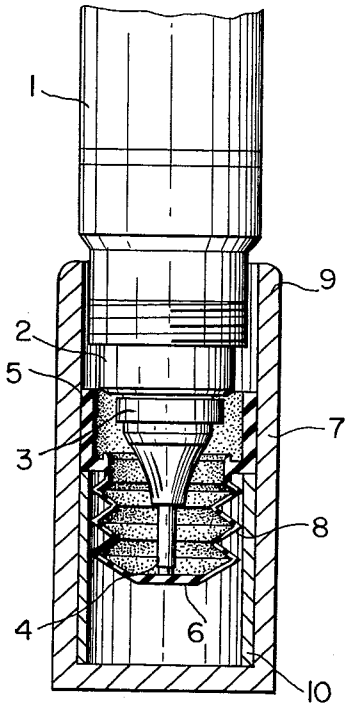
FIG. 1 is a fragmentary sectional view of a covering cap with a gasket element according to the invention, whereby the tubular writing element about to be inserted is positioned above the basket.

Covering cap 9 shown in FIG. 1 contains gasket element 5 according to the invention which, in order to fix its axial position, is placed on the upper edge of an inner sleeve element 10 fitted within covering cap 9.

Covering cap 9 serves the purpose of sealing off the front area of a tubular pen 1 from sleeve body 2. Cylindrical element 3 is fitted within sleeve body 2 as a support for the axially extending tubular writing element 4.

Gasket element 5 contains, below its upper edge, annular sealing surface 7 extending radially inwardly as a support for lateral wall 8. Wall 8 in the form of a bellows extends downwardly to the bottom surface 6 of the gasket element 5 so that this gasket element is essentially cup-shaped. Since lateral surface 8 is in the form of a bellows, wall 8 may be elastically extended in the axial direction of the gasket element.

When tubular pen 1 is inserted into the covering cap 9, the front end 4 of the tubular pen comes first into contact with the bottom surface 6 of the gasket element. Bottom surface 6, thusly, is pushed away in an axial direction from the annular sealing surface 7 owing to the bellows-like design of the lateral wall 8, i.e. due to its axial extension as a result of the force acting upon bottom surface 6. In this instance, the front end 4 of the tubular writing element rests, sealed-off, on bottom surface 6.

Figure 2:
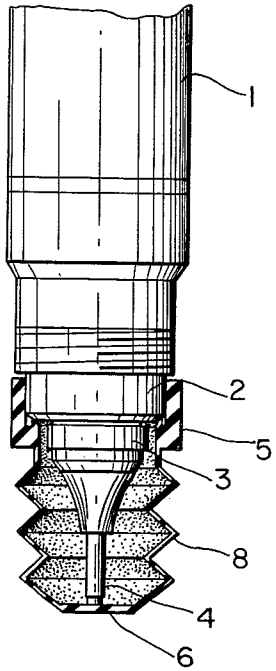
FIG. 2 shows the gasket element, according to FIG. 1 with the tubular writing element inserted whereby, for reasons of simplification, the covering cap supporting the gasket element has been omitted.

As is illustrated in FIG. 2 upon further pushing tubular pen 1 into covering cap 9, the front edge of the sleeve body 2 gets into contact with the annular sealing surface 7 (FIG. 2) so that the front end of the ink equalizing chamber is sealed off vis-a-vis the surrounding air. In this final position, the bottom surface 6 of the gasket element 5 pushes, owing to the elastic force of the lateral wall 8, against the front end of the tubular writing element 4 and seals it off. This elastic force is comparatively low, so that indeed a complete sealing-off is achieved but there is no danger that the tubular writing element might get bent or be broken off.

When covering cap 9 is removed from tubular pen 1, the bottom surface 6, owing to the elasticity of the lateral wall 8, returns into its original position, as shown in FIG. 1, so that, also when covering cap 9 is again placed upon tubular pen 1, the above described double sealing is achieved.

I claim

1. In a covering cap for the point of a capillary writing pen of the type having a sleeve supporting an ink reservoir in communication with an axially extending tubular writing point, a gasket comprising:

A. A cup-shaped inner sleeve, supportable against the inner wall of the covering cap and conformed complementally with the writing pen sleeve so as to define:
   i. a cylindrical guide
   ii. an upper edge shoulder engagable with the pen sleeve, and
   iii. a lower, radially inwardly extending annular seal, and B. An elongatable bellows-like sealing chamber depending from said annular seal and including an axially extendable bottom surface;

C. Said cup-shaped inner sleeve, as a writing pen tip is fitted therein, sealingly supporting the lower end of said sleeve and said bottom surface being axially, distended while sealingly engaging the writing point of said pen.

2. A gasket as in claim 1, said bellows-like sealing chamber having a bellows-like wall, together with a transverse bottom surface configured as a resilient seal engagable with the point of said pen.

3. A gasket as in claim 2, said cylindrical guide being configured as a longitudinal guide and transverse support for the lower end of said capillary writing pen sleeve, as said lower end engages said annular seal.

4. A gasket as in claim 3, said cup-shaped inner sleeve being supported medially of said cover by means of an inner cylindrical sleeve fitted within the bottom of the pen cover.

5. A gasket as in claim 4, said gasket being constructed of silicone rubber.

6. A gasket as in claim 5, said bellows-like wall being more resilient than the tubular writing point, so as to avoid damage to said writing point during sealing engagement.

* * * * *